United States Patent [19]

Le Coent

[11] Patent Number: 4,514,313

[45] Date of Patent: Apr. 30, 1985

[54] HIGH ALKALINITY SULFURIZED ALKYLPHENATES OF ALKALINE EARTH METALS AND METHOD OF MAKING SAME

[75] Inventor: Jean-Louis Le Coent, Le Havre, France

[73] Assignee: Orogil, Courbevoie, France

[21] Appl. No.: 507,804

[22] Filed: Jun. 24, 1983

[30] Foreign Application Priority Data

Jun. 24, 1982 [FR] France ..... 82 11060

[51] Int. Cl.[3] ..... C10M 1/54

[52] U.S. Cl. ..... 252/42.7; 252/49.7; 252/46.4

[58] Field of Search ..... 252/42.7, 49.7, 46.4

[56] References Cited

U.S. PATENT DOCUMENTS

| | | | |
|---|---|---|---|
| 3,256,186 | 7/1966 | Greenwald | 252/33 |
| 3,282,835 | 11/1966 | Asseff | 252/33.2 |
| 3,464,970 | 9/1969 | Sakai et al. | 260/137 |
| 3,862,981 | 1/1975 | Demoures et al. | 260/479 S |
| 3,936,480 | 2/1976 | Demoures et al. | 260/404.5 |
| 3,966,621 | 6/1976 | Watkins et al. | 252/42.7 |
| 4,016,093 | 5/1977 | Koft, Jr. | 252/42.7 |
| 4,042,514 | 8/1977 | Giolito et al. | 252/48.6 |
| 4,212,752 | 7/1980 | Peditto et al. | 252/42.7 |
| 4,222,882 | 9/1980 | Brulet et al. | 252/51.5 |
| 4,229,308 | 10/1980 | Brulet et al. | 252/47 |
| 4,251,379 | 2/1981 | Le Coent et al. | 252/33 |
| 4,302,342 | 11/1981 | Demoures et al. | 252/33.2 |
| 4,382,004 | 5/1983 | Tassara | 252/25 |

FOREIGN PATENT DOCUMENTS

| | | |
|---|---|---|
| 793197 | 6/1979 | South Africa . |
| 1144084 | 3/1969 | United Kingdom . |
| 1280749 | 7/1972 | United Kingdom . |

*Primary Examiner*—Jacqueline V. Howard

[57] ABSTRACT

High alkalinity sulfurized alkylphenates of alkaline earth metals useful as lubricating oil additives and methods of making them are disclosed. A sulfurized alkylphenol is neutralized with an alkaline-earth base in the presence of an oil, a glycol, and halide ions, the glycol being present in the form of a mixture with an alcohol having a boiling point above 150° C. Alcohol, glycol, water, and sediment are removed from the resultant medium and the medium is then carbonated. After carbonation, alcohol, glycol, water, and sediment are removed.

26 Claims, No Drawings

HIGH ALKALINITY SULFURIZED ALKYLPHENATES OF ALKALINE EARTH METALS AND METHOD OF MAKING SAME

BACKGROUND OF THE INVENTION

The present invention relates to a method of preparing high alkalinity sulfurized alkylphenates of alkaline earth metals useful as detergent-dispersant additives for lubricating oils, the additives prepared by this method, and lubricating oils containing these additives.

It is known in the art to prepare high alkalinity sulfurized calcium alkylphenates by sulfurizing and neutralizing dodecylphenol with sulfur and lime in the presence of an oil and a glycol (or by neutralizing a sulfurized alkylphenol with lime in the presence of an oil and a glycol), carbonating the resultant medium, distilling off the glycol, and filtering the oily solution containing the sulfurized calcium alkylphenate.

Because the glycol acts both as a dilution solvent and as a dispersant of the calcium carbonate in the medium, the prior art method has the drawback of requiring a large quantity of glycol, 50% of which remains in the final product and is detrimental to the engines with which the additive is used. Other drawbacks of the prior art include the high viscosity of the reaction medium, especially at the end of the sulfurization-neutralization step, the undesirable oxidation-reduction reactions that take place between the sulfur and the glycol, the results of which are detrimental to the performance of the end product (in particular the anti-oxidant properties of the end product), and the production of high quantities of $H_2S$ due to the large excess of sulfur necessary to sulfurize the alkylphenol.

SUMMARY OF THE INVENTION

The present invention solves many of the problems inherent in the prior art methods. For example, applicant's process has the advantages of lowering the viscosity of the reaction medium, especially after the sulfurization-neutralization step, thereby decreasing the quantity of dilution oil required, decreasing the quantity of residual glycol left in the product, decreasing the evolution of $H_2S$, and decreasing the extent of the oxidation-reduction reactions that take place between the sulfur and the glycol.

According to one preferred embodiment of the present invention, high alkalinity sulfurized alkylphenates of alkaline earth metals are prepared by neutralizing a sulfurized alkylphenol with an alkaline earth base in the presence of a dilution oil, a glycol, and halide ions, the glycol being present in the form of a mixture with an alcohol having a boiling point above 150° C., removing alcohol, glycol, water, and sediment, carbonating the reaction medium with $CO_2$ in the presence of halide ions, and again removing alcohol, glycol, water, and sediment.

According to another preferred embodiment of the present invention, the sulfurized alkylphenol is prepared in situ in the neutralization medium by reacting an alkylphenol with sulfur.

In either case, an amine or acetic acid or both may be used during neutralization.

The invention also relates to the additives per se and lubricating oil-additive mixtures.

DETAILED DESCRIPTION OF THE INVENTION

The additives of the invention are obtained by a process comprising the steps of:

(a) neutralizing a sulfurized alkylphenol with an alkaline earth base in the presence of a dilution oil, a glycol, and halide ions, the glycol being present in the form of a mixture with an alcohol having a boiling point above 150° C.;

(b) removing alcohol, glycol, and water from the medium, preferably by distillation;

(c) removing sediment from the medium, preferably by filtration;

(d) carbonating the resultant medium with $CO_2$ in the presence of halide ions;

(e) removing alcohol, glycol, and water from the medium, preferably by distillation; and (f) removing sediment from the medium, preferably by filtration.

As used herein, the term "sulfurized alkylphenol" refers to the mixture obtained by sulfurizing an alkylphenol with sulfur or sulfur chloride. The sulfurizing process is within the skill of the art. The mixture consists mainly of nonsulfurized alkylphenol and sulfurized alkylphenol. The sulfurized alkylphenol may be represented by the following formula:

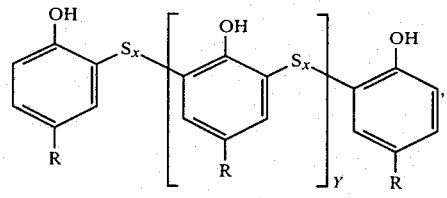

wherein R is a mono-valent alkyl radical of $C_9$ to $C_{30}$, preferably $C_9$ to $C_{22}$; x is from 1 to 3; and y is from 0 to 6.

The mixture constituting the "sulfurized alkylphenol" may be represented by the following average formula:

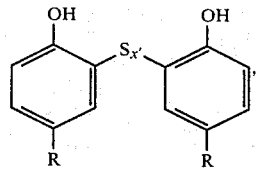

where x' is from 1 to 3, and generally from 1.4 to 2.5.

The alkaline earth bases useful in the present invention include the oxides and hydroxides of barium, strontium, and calcium, particularly lime.

Alcohols with a boiling point above 150° C. useful in the present invention include alcohols of $C_6$ to $C_{14}$ such as ethylhexanol, oxoalcohol, decylalcohol, tridecylalcohol; alkoxyalcohols such as 2-butoxyethanol, 2-butoxypropanol; and methyl ethers of dipropylene glycol.

The amines useful in the present invention include polyaminoalkanes, preferably polyaminoethanes, particularly ethylenediamine, and aminoethers, particularly tris(3-oxa-6-amino-hexyl)amine.

The glycols useful in the present invention include alkylene glycols, particularly ethylene glycol.

The halide ions employed in the present invention are preferably $Cl^-$ ions which may be added in the form of ammonium chloride or metal chlorides such as calcium chloride or zinc chloride.

The dilution oils suitable for use in the present invention include naphthenic oils and mixed oils and preferably paraffinic oils such as neutral 100 oil. The quantity of dilution oil used is such that the amount of oil in the final product constitutes from about 25% to about 65% by weight of the final product, preferably from about 30% to about 50%.

In one preferred embodiment, the process of the invention is characterized by the following:

the quantity of alcohol employed is such as to yield an alcohol to glycol molar ratio of from about 0.4, generaly from about 0.4 to about 10;

the quantity of alkaline earth base employed is such as to yield an alkaline earth base to sulfurized alkylphenol (expressed in moles of alkylphenol) molar ratio, of from about 0.4 to about 3, preferably from about 0.6 to about 2.5;

the quantity of glycol employed is such as to yield an alkaline earth base to glycol molar ratio of from about 2.6 to about 8, preferably from about 2.7 to about 6;

the neutralization and carbonation steps are carried out in the presence of a quantity of halide ions so that the ratio of gram atoms of halide to moles of alkaline earth base is from about 0.01 to about 0.15, preferably from about 0.015 to about 0.09; and the quantity of $CO_2$ employed in the carbonation step is such as to yield a $CO_2$ to alkaline earth metal molar ratio of from about 0.25 to about 0.75.

The neutralization step is preferably carried out at a temperature of from about 120° C. to about 180° C., more preferably from about 130° C. to about 170° C., at a pressure slightly below atmospheric pressure (from about $930\times10^2$ Pa to about $960\times10^2$ Pa), and optionally, in the presence of an amine or acetic acid or both. When an amine is used, the amount of amine employed preferably results in an amine to alkaline earth base molar ratio of up to about 0.2. When acetic acid is used, the amount of acetic acid employed preferably results in an acetic acid to alkaline earth base molar ratio of up to about 0.2, preferably up to about 0.1.

Following the neutralization and carbonation steps, alcohol, glycol, and water are removed, preferably by distillation, and sediment is removed, preferably by filtration.

Carbonation with $CO_2$ is preferably carried out at a temperature of from about 145° C. to about 180° C. at a pressure of from about $930\times10^2$ Pa to about $1010\times10^2$ Pa.

In another preferred embodiment, the sulfurized alkylphenol is prepared in situ in the neutralization medium by reacting an alkylphenol with sulfur. The quantity of sulfur used preferably corresponds to a molar ratio of sulfur to alkylphenol of from about 0.8 to about 2.

The sulfurization-neutralization step is preferably carried out at a temperature of from about 145° C. to about 175°0 C., more preferably from about 155° C. to about 170° C., and may be optionally carried out in the presence of an amine of the type useful in the general neutralization step.

In the second preferred embodiment, carbonation is carried out in the presence of halide ions preferably at a temperature of from about 155° C. to about 180° C., more preferably from about 165° C. to about 175° C.

The quantity of additive of this invention to be used with a particular lubricating oil depends on the intended use of the oil. Thus, for an oil for a gasoline engine, the quantity of additive to be employed is generally between 1% to about 2.5%; for an oil for a diesel engine, the quantity of additive is generally from 1.8% to about 4%; and for an oil for a marine engine, the quantity of additive may range up to about 30%.

A great variety of lubricating oils can be improved with the additives of the present invention. These oils include naphtha-based, paraffin-based, and mixed-based lubricating oils and other hydrocarbon-based lubricants, for example, lubricating oils derived from coal products and synthetic oils such as alkyleneoxide-type polymers and their derivatives, including alkyleneoxide polymers prepared by polymerizing an alkyleneoxide in the presence of water or an alcohol, for example, ethyl alcohol, the esters of dicarboxylic acids, liquid esters of phosphorus acids, alkylbenzenes and dialkylbenzenes, polyphenyls, alkylbiphenylethers, and silicon polymers.

Other additives may also be added to the lubricating oils, for example, anti-oxidant additives, anti-corrosion additives and ashless dispersant additives.

The following examples present illustrative but non-limiting embodiments of this invention.

EXAMPLES

Characteristics Of The Product

In these experiments, product characteristics were measured according to the following procedures:

1. Measurement of the amount of sediment

The amount of sediment is determined according to ASTM Standard D 2273-67, with the following modifications:

a. Rotational speed of the centrifuge: 6,000 rpm;

b. Relative centrifugal force: 10,000;

c. The product to be analyzed is diluted to a ratio of 1:4 with gasoline E (25 $cm^3$ of product to be analyzed to 75 $cm^3$ of gasoline E);

d. Duration of centrifuging: 10 minutes.

2. Compatibility test

This test was carried out by adding an amount of the finished product to be tested to an SAE (Society Of Automotive Engineers) 50 oil of paraffinic tendency so as to obtain a solution containing 25% additive.

The solution was stored for 24 hours, then centrifuged under the following conditions:

a. Rotational speed of centrifuge: 6,000 rpm;

b. Relative centrifugal force: 10,000;

c. Duration of centrifuging: 1 hour.

The amount of sediment was then measured.

First General Method Of Additive Preparation

(A) Sulfurization, dehydration, and neutralization

A reaction vessel is charged with the following under constant stirring:

(a) dodecylphenol (DDP);

(b) sulfur (c) lime;

(d) calcium chloride, zinc chloride or ammonium chloride; and (e) a dilution oil.

The vessel is heated to 160° C., and a mixture of ethylene glycol and ethylhexanol is slowly added over a period of 80 minutes under a slightly reduced pressure of about $960\times10^2$ Pa.

The reaction medium is then allowed to stand for 1 hour at 165° C. under a slightly reduced pressure of about $930\times10^2$ Pa and a distillate, $D_1$, is collected.

(B) Carbonation

Carbonation is carried out for 100 minutes at a temperature of from about 165° C. to about 175° C. at atmospheric pressure. The remaining dilution oil is then added.

(C) Removal of alcohol, glycol, and water

Alcohol, glycol, and water are distilled off by heating at 190° C. for 1 hour while gradually applying a vacuum until the pressure reaches $66.5\times10^2$ Pa.

Stripping with nitrogen is then carried out for 1 hour at 190° C. and a distillate, $D_2$, is collected.

(D) Removal of sediment

The product medium is then filtered to remove sediment.

EXAMPLES 1 THROUGH 8

The reaction conditions for Examples 1 through 8 were as described above. The quantities of reactants and reagents used in the different steps of Examples 1 through 8 are summarized in Tables I through IV; the results obtained are summarized in Tables III and IV.

Second General Method Of Additive Preparation (A) Neutralization

A reaction vessel is charged with:

(a) sulfurized DDP containing about 11% sulfur;

(b) lime;

(c) calcium chloride; and (d) a dilution oil.

The medium is heated to 130° C. and a mixture of ethylene glycol and ethylhexanol or 2-butoxyethanol is added. The medium is next heated to 145° C. and then allowed to stand for 30 minutes under a vacuum of $345\times10^2$ Pa. A distillate, $D_1$, is collected and the vacuum is broken.

(B) Carbonation

Carbonation is carried out for 100 minutes at atmospheric pressure. The temperature is about 145° C. at the beginning of the carbonation and the medium is heated to attain a temperature of about 170° C. at the end of the carbonation. The remaining dilution oil is added at the end of the carbonation.

(C) Removal of alcohol, glycol, and water

Alcohol, glycol, and water are distilled off by heating to 190° C. while gradually applying a vacuum until the pressure reaches $66.5\times10^2$ Pa. The medium is next allowed to stand at 190° C. for 1 hour.

Stripping with nitrogen is then carried out for 1 hour at 190° C., and a distillate, $D_2$, is collected.

(D) Removal of sediment

The product medium is then filtered to remove the sediment.

EXAMPLES 9 THROUGH 11

The reaction conditions for Examples 9 through 11 were as described above. The quantities of reactants and reagents used in the different steps of Examples 9 through 11 are summarized in Tables II through IV; the results obtained are summarized in Tables III and IV.

TABLE I

| EXAMPLES | 1 | 2 | 3 | 4 | 5 | 6 | 7 |
|---|---|---|---|---|---|---|---|
| Step A | | | | | | | |
| DDP, g | 100 | 100 | 100 | 100 | 100 | 100 | 100 |
| S, g | 12.8 | 12.8 | 12.8 | 12.8 | 12.8 | 12.8 | 12.8 |
| Lime, g | 45 | 45 | 45 | 45 | 45 | 49.5 | 49.5 |
| Sulfurized DDP, g | — | — | — | — | — | — | — |
| $CaCl_2$, g | 1.4 | 1.4 | — | — | 1.4 | 1.4 | — |
| $ZnCl_2$, g | — | — | 1.4 | — | — | — | — |
| $NH_4Cl$, g | — | — | — | 1.4 | — | — | — |
| Oil, g | 35 | 35 | 35 | 35 | 35 | 35 | 35 |
| Ethylene glycol, g | 16 | 11 | 11 | 11 | 11 | 12.6 | 12.6 |
| Ethylhexanol, g | 44 | 20 | 20 | 20 | 20 | 20 | 20 |
| 2-butoxyethanol, g | — | — | — | — | — | — | — |
| $D_1$* | | | | | | | |
| $H_2O$ | 11 | 11 | 11 | 11 | 11 | 12.2 | 12.2 |
| Ethylene glycol, g | 1 | 1 | 1 | 1 | 1 | 2 | 2 |
| Ethylhexanol, g | 8 | 7 | 7 | 7 | 7 | 7 | 7 |
| 2-butoxyethanol, g | — | — | — | — | — | — | — |
| Step B | | | | | | | |
| $CO_2$, g | 14.6 | 14.7 | 14.4 | 15 | 14.7 | 17 | 17 |
| Oil, g | 35 | 35 | 35 | 35 | 44 | 35 | 35 |
| $D_2$** | | | | | | | |
| Ethylene glycol, g | 9 | 6 | 6 | 6 | 6 | 7 | 7 |
| Ethylhexanol, g | 35 | 12 | 12 | 12 | 12 | 12 | 12 |
| 2-butoxyethanol, g | — | — | — | — | — | — | — |
| $H_2S$ evolved, g | 4.8 | 4.8 | 4.7 | 4.9 | 4.8 | 4.8 | 4.8 |

*$D_1$ is the distillate collected at the end of the sulfurization, dehydration, and neutralization step.

**$D_2$ is the distillate collected after the stripping procedure which follows the removal of alcohol, glycol, and water.

TABLE II

| EXAMPLES | 8 | 9 | 10 | 11 |
|---|---|---|---|---|
| Step A | | | | |
| DDP, g | 100 | — | — | — |
| S, g | 12 | — | — | — |
| Lime, g | 25 | 45 | 45 | 44.5 |
| Sulfurized DDP, g | — | 110 | 110 | 110 |
| $CaCl_2$, g | 1.4 | 1.4 | 1.4 | 1.4 |
| $ZnCl_2$, g | — | — | — | — |
| $NH_4Cl$, g | — | — | — | — |
| Oil, g | 40 | 35 | 35 | 35 |
| Ethylene glycol, g | 7 | 11 | 11 | 7 |
| Ethylhexanol, g | 15 | 20 | 20 | — |
| 2-butoxyethanol, g | — | — | — | 20 |
| $D_1$* | | | | |
| $H_2O$, g | 6 | 11 | 11 | 11 |
| Ethylene glycol, g | 0.5 | 1 | 1 | 1 |
| Ethylhexanol, g | 5 | 7 | 7 | — |
| 2-butoxyethanol, g | — | — | — | 8 |
| Step B | | | | |
| $CO_2$, g | 4.6 | 14.8 | 14.8 | 14.8 |
| Oil, g | 46 | 44 | 44 | 44 |
| $D_2$** | | | | |
| Ethylene glycol, g | 3.2 | 6 | 7 | 4 |
| Ethylhexanol, g | 9 | 12 | 12 | — |
| 2-butoxyethanol, g | — | — | — | 11 |
| $H_2S$ evolved, g | 3.9 | 0.8 | 0.8 | 0.9 |

*$D_1$ is the distillate collected at the end of the neutralization step.

**$D_2$ is the distillate collected after the stripping procedure which follows the removal of alcohol, glycol, and water.

TABLE III

| EXAMPLES | 1 | 2 | 3 | 4 | 5 | 6 | 7 |
|---|---|---|---|---|---|---|---|
| Step D | | | | | | | |
| Filtration | 130 | 120 | 140 | 110 | 160 | 120 | 40 |

TABLE III-continued

| EXAMPLES | 1 | 2 | 3 | 4 | 5 | 6 | 7 |
|---|---|---|---|---|---|---|---|
| rate, kg/hr/m$^2$ | | | | | | | |
| Crude sediment, % | 1.4 | 1.4 | 1.3 | 1.5 | 1.3 | 1.4 | 5 |
| Analysis of End Product | | | | | | | |
| Ca, % | 10.47 | 10.48 | 10.5 | 10.34 | 10.1 | 11.2 | 8.8 |
| S, % | 3.6 | 3.6 | 3.65 | 3.55 | 3.42 | 3.3 | 3.6 |
| Viscosity at 100° C., cst | 380 | 330 | 320 | 360 | 250 | 394 | 170 |
| T.B.N. (ASTM 2896) | 281 | 281 | 282 | 277 | 270 | 302 | 240 |
| Sediment, % | 0.02 | 0.04 | 0.03 | 0.04 | 0.01 | 0.04 | 0.03 |
| $CO_2$, % | 5.05 | 5.1 | 5.3 | 5.2 | 5.2 | 5.6 | 4.8 |
| Ethylene glycol, % | 2 | 1.5 | 1.5 | 1.5 | 1.5 | 1.7 | 2 |
| Compatibility test | * | * | * | * | * | * | * |

*Trace amounts.

TABLE IV

| EXAMPLES | 8 | 9 | 10 | 11 |
|---|---|---|---|---|
| Step D | | | | |
| Filtration rate kg/hr/m$^2$ | 210 | 120 | 120 | 120 |
| Crude sediment, % | 0.6 | 1.3 | 1.2 | 1.4 |
| Analysis Of End Product | | | | |
| Ca, % | 5.85 | 10.47 | 10.45 | 10.4 |
| S, % | 3.45 | 3.5 | 3.7 | 3.7 |
| Viscosity at 100° C., cst | 120 | 380 | 410 | 410 |
| T.B.N. (ASTM 2896) | 161 | 280 | 280 | 279 |
| Sediment, % | .04 | 0.03 | 0.05 | 0.05 |
| $CO_2$, % | 2 | 5.3 | 5.3 | 5.3 |
| Ethylene glycol, % | 1 | 1.4 | 1 | 0.5 |
| Compatibility test | * | * | * | * |

Trace amounts.

Third General Method of Additive Preparation (A) Sulfurization, dehydration, and neutralization A reaction vessel is charged with the following under constant stirring:

(a) dodecylphenol;
(b) sulfur;
(c) lime;
(d) calcium chloride or ammonium chloride; and
(e) a dilution oil.

The medium is heated to 155° C. under a slightly reduced pressure of $930\times10^2$ Pa and a first alcohol charge comprised of a mixture of ethylene glycol and 2-butoxyethanol or 2-butoxypropanol is slowly added over a period of 30 minutes followed by the addition of a second alcohol charge comprised of 2-butoxyethanol or 2-butoxypropanol alone over a period of 40 minutes.

The mixture is allowed to stand for 1 hour at 165° C. at a slightly reduced pressure of $930\times10^2$ Pa and a distillate, $D_1$, is collected.

(B) Carbonation

Carbonation is carried out for 120 minutes at 165° C. at atmospheric pressure. A dilution oil is then added slowly.

(C) Removal of alcohol, glycol, and water

The alcohol, glycol, and water are distilled off by heating for 1 hour at 190° C. and gradually applying a vacuum until the pressure reaches $66.5\times10^2$ Pa.

Stripping with nitrogen is next carried out for 1 hour at 190° C. and a distillate, $D_2$, is collected.

(D) Removal of sediment

The product medium is then filtered to remove sediment.

EXAMPLES 12 THROUGH 23 AND 28

The reaction conditions for Examples 12 through 23 and 28 were as described above. The quantities of reactants and reagents used in the different steps of Examples 12 through 23 and 28 are summarized in Tables V through VIII. The results obtained are summarized in Table VI and VIII.

EXAMPLE 24

In Example 24, the same procedure was followed as in Example 13 with the exception that the mixture of 10 g of ethylene glycol and 10 g of 2-butoxyethanol (first charge) was added at the beginning of Step A and not when the temperature reached 155° C. The results obtained were identical to those for Example 13.

EXAMPLE 25

In Example 25, the same procedure was followed as in Example 12 with the exception that 10 g of glycol were added at the beginning of Step A followed by the addition of 10 g of 2-butoxyethanol when the temperature reached 155° C. The results obtained were identical to those for Example 12.

EXAMPLE 26

In Example 26, the same procedure was followed as in Examples 9 through 11. The reactants were the same, with the exception that a sulfurized dodecylphenol containing about 8% sulfur instead of 11% sulfur was used. The quantities of reactants and reagents used in the different steps are summarized in Tables VII and VIII; the results obtained are summarized in Table VIII.

EXAMPLE 27

In Example 27, the same procedure was followed as in Example 26. The reactants were the same with the exception that a dodecylphenol containing about 7% sulfur was used together with an additional quantity of sulfur. The quantities of reactants and reagents used in the different steps are summarized in Tables VII and VIII; the results obtained are summarized in Table VIII.

TABLE V

| EXAMPLES | 12 | 13 | 14 | 15 | 16 | 17 | 18 |
|---|---|---|---|---|---|---|---|
| Step A | | | | | | | |
| DDP, g | 87.5 | 87.5 | 75 | 87.5 | 87.5 | 87.5 | 75 |
| S, g | 10.9 | 10.9 | 9.2 | 10.9 | 10.9 | 9.5 | 13.5 |
| Lime, g | 44 | 44 | 44 | 44 | 44 | 44 | 44 |
| Sulfurized DDP, g | — | — | — | — | — | — | — |

TABLE V-continued

| EXAMPLES | 12 | 13 | 14 | 15 | 16 | 17 | 18 |
|---|---|---|---|---|---|---|---|
| $NH_4Cl$, g | — | — | 2 | — | — | — | — |
| $CaCl_2$, g | 2 | 2 | — | 2 | 2 | 2 | 2 |
| $CH_3COOH$, g | — | — | — | — | — | — | — |
| Oil, g | 35 | 35 | 35 | 35 | 35 | 35 | 35 |
| Ethylene glycol, g | 10 | 6.2 | 10 | 9.2 | 13.2 | 10 | 10 |
| 2-butoxy-ethanol, g | 10 + 70 | 10 + 70 | 10 + 70 | 10 + 70 | 10 + 70 | 10 + 70 | 10 + 70 |
| 2-butoxy-propanol, g | — | — | — | — | — | — | — |
| $D_1$* | | | | | | | |
| $H_2O$, g | 11 | 11 | 11 | 11 | 11 | 11 | 11 |
| Ethylene glycol, g | 4 | 1 | 4 | 3 | 4 | 4 | 4 |
| 2-butoxy-ethanol, g | 15 | 15 | 15 | 15 | 15 | 15 | 15 |
| 2-butoxy-propanol, g | — | — | — | — | — | — | — |

*$D_1$ is the distillate collected after the sulfurization, dehydration, and neutralization step.

TABLE VI

| EXAMPLES | 12 | 13 | 14 | 15 | 16 | 17 | 18 |
|---|---|---|---|---|---|---|---|
| Step B | | | | | | | |
| $CO_2$, g | 14 | 15 | 14 | 14 | 14 | 14 | 14 |
| Oil, g | 35 | 35 | 35 | 35 | 35 | 35 | 35 |
| $D_2$* | | | | | | | |
| Ethylene glycol, g | 1 | 1 | 1 | 1 | 1 | 1 | 1 |
| 2-butoxy-ethanol, g | 62 | 62 | 62 | 62 | 62 | 62 | 62 |
| 2-butoxy-propanol, g | — | — | — | — | — | — | — |
| $H_2S$ evolved, g | 3 | 3 | 2.7 | 2.6 | 3.3 | 2.6 | 3.6 |

TABLE VI-continued

| EXAMPLES | 12 | 13 | 14 | 15 | 16 | 17 | 18 |
|---|---|---|---|---|---|---|---|
| T.B.N. (ASTM 2896) | 307 | 285 | 309 | 308 | 298 | 307 | 307 |
| Sediment, % | 0.08 | 0.08 | 0.07 | 0.07 | 0.08 | 0.07 | 0.06 |
| $CO_2$, % | 6.6 | 5.8 | 5.9 | 5.9 | 6.0 | 6.1 | 6.3 |
| Ethylene glycol, % | 2 | 1.4 | 1.5 | 1.9 | 2.6 | 2 | 2 |
| Compatibility test | ** | ** | ** | ** | ** | 0.2 | ** |

*$D_2$ is the distillate collected after the stripping proceduring which follows the removal of alcohol, glycol, and water.
**Trace amounts.

TABLE VII

| EXAMPLES | 19 | 20 | 21 | 22 | 23 | 26 | 27 | 28 |
|---|---|---|---|---|---|---|---|---|
| Step A | | | | | | | | |
| DDP, g | 87.5 | 87.5 | 87.5 | 87.5 | 87.5 | — | — | 75 |
| S, g | 10.9 | 10.9 | 10.9 | 10.9 | 10.9 | 0 | 2.5 | 10 |
| Lime, g | 44 | 44 | 44 | 44 | 44 | 44 | 44 | 50 |
| Sulfurized DDP, g | — | — | — | — | — | 82 | 82 | — |
| $NH_4Cl$, g | — | — | — | — | — | 2 | 2 | — |
| $CaCl_2$, g | — | 0.5 | 0.5 | 2 | 2 | — | — | 2 |
| $CH_3COOH$, g | — | — | 1 | — | — | — | — | 1 |
| Oil, g | 35 | 35 | 35 | 35 | 35 | 35 | 35 | 35 |
| Ethylene glycol, g | 10 | 10 | 10 | 10 | 10 | 10 | 10 | 10 |
| 2-butoxy-ethanol, g | 10 + 70 | 10 + 70 | 10 + 70 | — | — | 10 + 70 | 10 + 70 | 10 + 70 |
| 2-butoxy-propanol, g | — | — | — | 10 + 70 | — | — | — | — |
| $D_1$* | | | | | | | | |
| $H_2O$, g | 11 | 11 | 11 | 11 | 11 | 11 | 11 | 12 |
| Ethylene glycol, g | 4 | 4 | 4 | 4 | 4 | 4 | 4 | 4 |
| 2-butoxy-ethanol, g | 15 | 15 | 15 | — | — | 15 | 15 | 15 |
| 2-butoxy-propanol, g | — | — | — | 15 | — | — | — | — |

*$D_1$ is the distillate collected after the sulfurization, dehydration, and neutralization step.

| | | | | | | | |
|---|---|---|---|---|---|---|---|
| Step D | | | | | | | |
| Filtration rate kg/hr/m$^2$ | 130 | 95 | 100 | 95 | 96 | 105 | 105 |
| Crude sediment, % | 1.4 | 2 | 1.8 | 1.4 | 2.4 | 1.8 | 1.8 |
| Analysis Of End Product | | | | | | | |
| Ca, % | 11.2 | 10.4 | 11.4 | 11.3 | 10.8 | 11.2 | 11.2 |
| S, % | 3.5 | 3.4 | 2.9 | 3.6 | 3.3 | 3.1 | 3.5 |
| Viscosity at 100° C., cst | 406 | 478 | 404 | 395 | 480 | 336 | 448 |

TABLE VIII

| EXAMPLES | 19 | 20 | 21 | 22 | 23 | 26 | 27 | 28 |
|---|---|---|---|---|---|---|---|---|
| Step B | | | | | | | | |
| $CO_2$, g | 16 | 15 | 14 | 14 | 14 | 14 | 14 | 16 |
| Oil, g | 35 | 35 | 35 | 35 | 35 | 35 | 35 | 35 |
| $D_2$* | | | | | | | | |
| Ethylene glycol, g | 1 | 1 | 1 | 1 | 1 | 1 | 1 | 1 |
| 2-butoxy-ethanol, g | 62 | 62 | 62 | — | — | 62 | 62 | 62 |
| 2-butoxy- | — | — | — | 62 | — | — | — | — |

TABLE VIII-continued

| EXAMPLES | 19 | 20 | 21 | 22 | 23 | 26 | 27 | 28 |
|---|---|---|---|---|---|---|---|---|
| propanol, g | | | | | | | | |
| $H_2S$ evolved, g | 2.6 | 2.9 | 3 | 3 | 3.6 | 0.6 | 1 | 2.9 |
| Step D | | | | | | | | |
| Filtration rate, kg/hr/m$^2$ | 30 | 40 | 95 | 88 | 20 | 110 | 120 | 95 |
| Crude sediment, % | 6 | 4 | 1.3 | 1.4 | 8 | 1.2 | 1.5 | 2 |
| Analysis of End Product | | | | | | | | |
| Ca, % | 8.3 | 9.7 | 11.2 | 11 | 7.8 | 11.3 | 11.2 | 12.2 |
| S, % | 3.6 | 3.7 | 3.5 | 3.5 | 3.6 | 3.6 | 3.6 | 2.9 |
| Viscosity at 100° C., cst | 230 | 292 | 398 | 372 | 295 | 380 | 396 | 530 |
| T.B.N. (ASTM 2896) | 230 | 268 | 308 | 304 | 215 | 308 | 306 | 332 |
| Sediment, % | 0.07 | 0.06 | 0.06 | 0.06 | 0.04 | 0.05 | 0.05 | 0.01 |
| $CO_2$, % | 5.0 | 5.4 | 6.7 | 6.5 | 4.6 | 6.5 | 6.4 | 6.8 |
| Ethylene glycol, % | 2 | 2 | 2 | 2 | 2 | 2 | 2 | 2 |
| Compatibility test | ** | * | ** | ** | ** | ** | ** | ** |

*$D_2$ is the distillate collected after the stripping procedure which follows the removal of alcohol, glycol, and water.
**Trace amounts.

I claim:

1. A method of preparing high alkalinity sulfurized alkylphenates of alkaline earth metals, comprising the steps of:
   (a) neutralizing a sulfurized alkylphenol in a neutralization medium with an alkaline earth base, the quantity of said alkaline earth base being such as to yield an alkaline earth base to alkylphenol molar ratio of from about 0.4/1 to about 3/1, said neutralization being performed in the presence of such quantities of a dilution oil, a glycol, and halide ions, the glycol being present in the form of a mixture with an alcohol having a boiling point above 150° C., so as to yield an alcohol to glycol molar ratio of at least about 0.4/1, an alkaline earth base to glycol molar ratio of from about 2.6/1 to about 8/1, and a molar ratio of halide ions to alkaline earth base of from about 0.01/1 to about 0.15/1;
   (b) removing alcohol, glycol, and water from the medium;
   (c) removing sediment from the medium;
   (d) carbonating the medium, in the presence of halide ions, with a quantity of $CO_2$ so as to yield a $CO_2$ to alkaline earth metal molar ratio of from about 0.25/1 to about 0.75/1;
   (e) removing alcohol, glycol, and water from the medium; and
   (f) removing sediment from the medium.

2. The method of claim 1 wherein the alkaline earth base is calcium hydroxide.

3. The method of claim 1 wherein the alcohol is an alcohol of $C_6$ to $C_{14}$.

4. The method of claim 3 wherein the alcohol is ethylhexanol.

5. The method of claim 1 wherein the alcohol is an alkoxyalcohol.

6. The method of claim 5 wherein the alkoxyalcohol is 2-butoxyethanol.

7. The method of claim 1 wherein the halide ions are chloride ions.

8. The method of claim 7 wherein the chloride ions are added in the form $CaCl_2$.

9. The method of claim 7 wherein the chloride ions are added in the form of $ZnCl_2$.

10. The method of claim 7 wherein the chloride ions are added in the form of $NH_4Cl$.

11. The method of claim 1 wherein neutralization step (a) is carried out in the presence of a dilution oil, a glycol, halide ions, and an amine, the glycol being present in the form of a mixture with an alcohol having a boiling point above 150° C.

12. The method of claim 11 wherein the amine is present in such quantities as to yield an amine to alkaline earth base molar ratio of up to about 0.2.

13. The method of claim 11 wherein the amine is ethylenediamine.

14. The method of claim 11 wherein the amine is tris(3-oxa-6-aminohexyl)amine.

15. The method of claim 1 wherein neutralization step (a) is carried out in the presence of a dilution oil, a glycol, halide ions, and acetic acid, the glycol being present in the form of a mixture with an alcohol having a boiling point above 150° C.

16. The method of claim 15 wherein the acetic acid is present in an amount so as to yield an acetic acid to alkaline earth base molar ratio of up to about 0.2.

17. The method of claim 16 wherein the acetic acid is present in an amount so as to yield an acetic acid to alkaline earth base molar ratio of up to about 0.1.

18. The method of claim 1 wherein neutralization step (a) is carried out in the presence of a dilution oil, a glycol, halide ions, an amine, and acetic acid, the glycol being present in the form of a mixture with an alcohol having a boiling point above 150° C.

19. The method of claim 1 wherein in neutralization step (a) the quantities of reactants and reagents are such as to yield an alcohol to glycol molar ratio of from about 0.4 to about 10, an alkaline earth base to alkylphenol molar ratio of from about 0.6 to about 2.5, an alkaline earth base to glycol molar ratio of from about 2.7 to about 6, and a ratio of gram atoms of halide ions to moles of alkaline earth base of from about 0.015 to about 0.09.

20. The method of claim 1 wherein the sulfurized alkylphenol is prepared in situ in the neutralization medium by reacting an alkylphenol with sulfur.

21. A lubricating oil additive prepared according to a method comprising the steps of:
   (a) neutralizing a sulfurized alkylphenol in a neutralization medium with an alkaline earth base, the quantity of said alkaline earth base being such as to yield an alkaline earth base to alkylphenol molar ratio of from about 0.4/1 to about 3/1, said neutralization being performed in the presence of such quantities of a dilution oil, a glycol, and halide ions, the glycol being present in the form of a mixture with an alcohol having a boiling point above 150° C., so as to yield an alcohol to glycol molar ratio of at least about 0.4/1, an alkaline earth base to glycol molar ratio of from about 2.6/1 to about 8/1, and a molar ratio of halide ions to alkaline earth base of from about 0.01/1 to about 0.15/1;
   (b) removing alcohol, glycol, and water from the medium;
   (c) removing sediment from the medium;
   (d) carbonating the medium in the presence of halide ions, with a quantity of $CO_2$ so as to yield a $CO_2$ to alkaline earth metal molar ratio of from about 0.25/1 to about 0.75/1;

(e) removing alcohol, glycol, and water from the medium; and (f) removing sediment from the medium.

22. A lubricating oil additive prepared according to the method of claim 21, wherein the sulfurized alkylphenol is prepared in situ in the neutralization medium by reacting the alkylphenol with sulfur.

23. An improved lubricating oil containing the additive of claim 21.

24. An improved lubricating oil containing the additive of claim 22.

25. A method of improving the detergent and dispersant properties of lubricating oils, comprising adding to said oils an effective amount of the additive of claim 21.

26. A method of improving the detergent and dispersant properties of lubricating oils, comprising adding to said oils an effective amount of the additive of claim 22.

* * * * *